US010619482B2

(12) United States Patent
Stokes

(10) Patent No.: US 10,619,482 B2
(45) **Date of Patent: *Apr. 14, 2020**

(54) METHOD OF MINING ORE

(71) Applicant: Technological Resources Pty. Limited, Melbourne (AU)

(72) Inventor: Andrew Stokes, Bundoora (AU)

(73) Assignee: Technological Resources Pty. Limited, Melbourne, Victoria (AU)

( * ) Notice: Subject to any disclaimer, the term of this patent is extended or adjusted under 35 U.S.C. 154(b) by 0 days.

This patent is subject to a terminal disclaimer.

(21) Appl. No.: 15/813,220

(22) Filed: Nov. 15, 2017

(65) Prior Publication Data

US 2018/0073360 A1 Mar. 15, 2018

Related U.S. Application Data

(63) Continuation of application No. 14/477,120, filed on Sep. 4, 2014, now Pat. No. 9,845,676, which is a continuation of application No. 13/133,365, filed as application No. PCT/AU2009/001591 on Dec. 8, 2009, now Pat. No. 8,840,190.

(30) Foreign Application Priority Data

Dec. 8, 2008 (AU) ..... 2008906338

(51) Int. Cl.

| | |
|---|---|
| ***E21C 41/00*** | (2006.01) |
| ***E21C 41/30*** | (2006.01) |
| ***E21C 41/26*** | (2006.01) |

(52) U.S. Cl.
CPC ..... *E21C 41/30* (2013.01); *E21C 41/00* (2013.01); *E21C 41/26* (2013.01)

(58) Field of Classification Search
CPC ..... E21C 41/26–31
See application file for complete search history.

(56) References Cited

U.S. PATENT DOCUMENTS

| | | | |
|---|---|---|---|
| 4,167,826 | A | 9/1979 | Feliz |
| 5,007,496 | A | 4/1991 | Whitten et al. |
| 5,586,030 | A | 12/1996 | Kemner et al. |
| 6,134,493 | A | 10/2000 | Kaneko |

(Continued)

OTHER PUBLICATIONS

AutoMine http://mining.sandvik.com/sandvik/0120/Internet/Global/S003713.nsf/Alldocs/22E4D2183, Printed Apr. 19, 2013.

(Continued)

*Primary Examiner* — Janine M Kreck
(74) *Attorney, Agent, or Firm* — Banner & Witcoff, Ltd.

(57) ABSTRACT

An open cut mine includes an area to be mined bounded by a perimeter. The area to be mined includes (a) a manned zone within the perimeter in which manned resources operate to the exclusion of unmanned resources, (b) an unmanned zone within the perimeter in which unmanned resources operate to the exclusion of manned resources, (c) a first manned resource access location in the perimeter including a roadway through which manned resources move into and from the manned zone, and (d) a separate second unmanned resource access location in the perimeter including a roadway through which unmanned resources move into and from the unmanned zone.

7 Claims, 9 Drawing Sheets

(56) References Cited

U.S. PATENT DOCUMENTS

Figure 1:
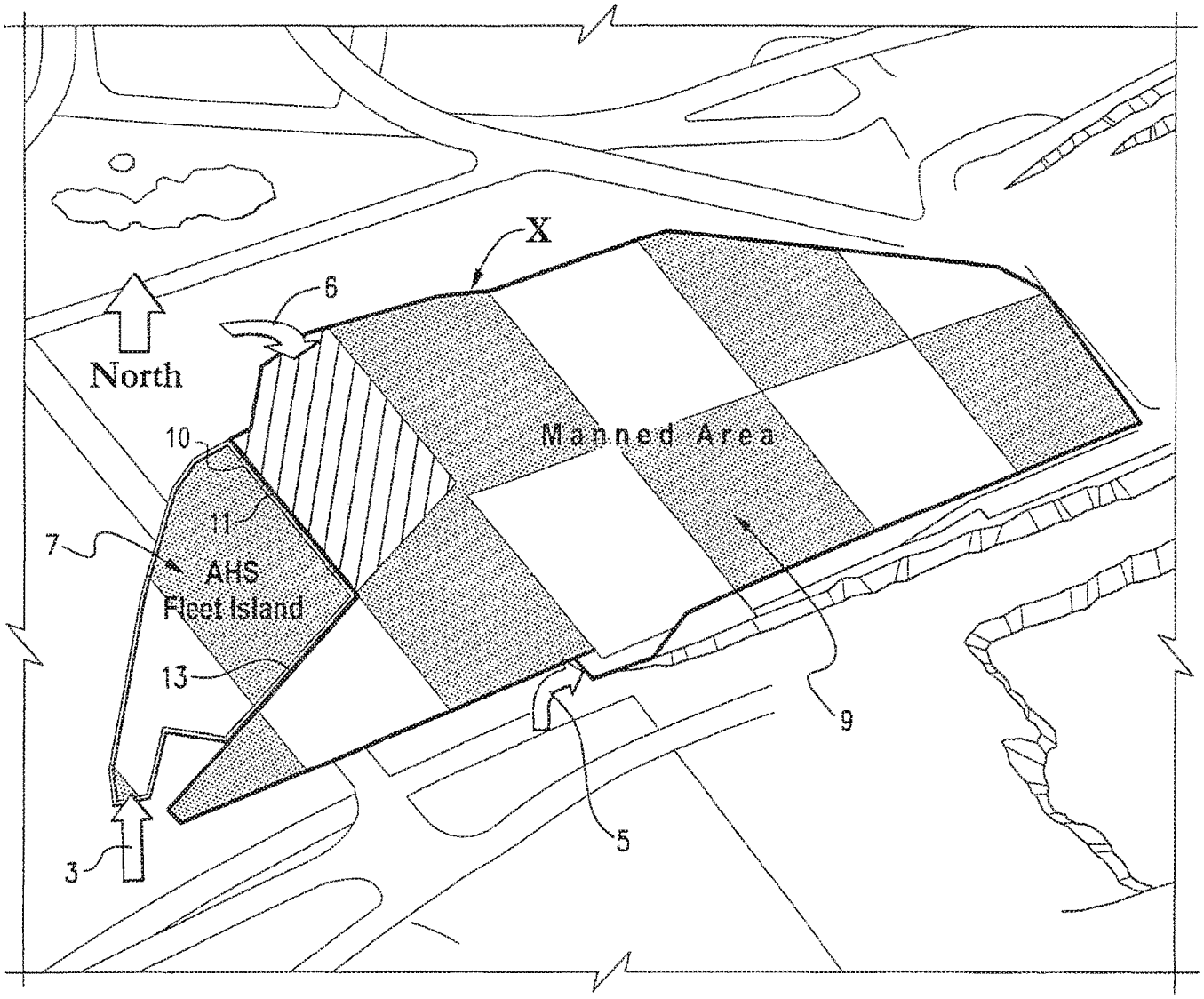

| | | | | |
|---|---|---|---|---|
| 6,292,725 | B1 * | 9/2001 | Kageyama | G05D 1/027 180/169 |
| 6,351,697 | B1 | 2/2002 | Baker | |
| 6,470,989 | B1 | 10/2002 | Puputti et al. | |
| 6,480,769 | B1 | 11/2002 | Kageyama | |
| 6,484,078 | B1 | 11/2002 | Kageyama | |
| 6,799,100 | B2 | 9/2004 | Burns et al. | |
| 7,162,347 | B2 | 1/2007 | Shibamori et al. | |
| 7,337,865 | B2 | 3/2008 | Cook et al. | |
| 8,840,190 | B2 * | 9/2014 | Stokes | E21C 41/26 299/1.9 |
| 9,845,676 | B2 * | 12/2017 | Stokes | E21C 41/30 |
| 2004/0040792 | A1 | 3/2004 | Uranaka et al. | |
| 2006/0249321 | A1 | 11/2006 | Cook et al. | |
| 2011/0299730 | A1 | 12/2011 | Elinas et al. | |

OTHER PUBLICATIONS

Australian Patent Application PCT/AU2009/001591, International Search Report, dated Feb. 25, 2010.

Martin Creamer, Manless Mining, http://www.miningweekly.com/pring-version/manless-mining, dated Dec. 12, 2003.

* cited by examiner

METHOD OF MINING ORE

The present invention relates to mining ore in an open pit mine.

The present invention is concerned with providing a method of mining ore in an open pit mine that reduces the interaction of manned resources and unmanned resources operating in the pit.

The term "unmanned resources" is understood herein to include equipment that is used in mining operations that can operate under remote control or autonomously. The equipment may be mobile and, for example, be wheel-mounted or track-mounted and may include haulage trucks. The equipment may also be non-mobile in the sense that it has to be trucked or otherwise transported to a location in a mine.

The term "manned resources" is understood herein to include (a) people who carry out mining operations, such as geologists, operators taking samples for analysis, operators carrying out maintenance of equipment, and operators drilling blastholes and filling the blastholes with explosives and (b) manually-operated equipment used in mining operations, for example manually driven haul trucks.

The term "equipment", unmanned and manned, may include any one or more of haulage vehicles, water trucks, rope shovels, hydraulic excavators, front end loaders, dozers, graders, drill rigs, hole charging equipment, survey trucks, and explosives trucks.

The present invention has particular application to mining iron ore and is described hereinafter in this context. However, it is noted that the present invention is not limited to mining iron ore.

Conventional open pit mining of iron ore comprises progressively drilling and blasting sections of an ore body so that the ore can be picked up by shovels or other suitable excavators and transported from a pit on haulage trucks. It is known to mine iron ore in large blocks using a series of benches so that various mining activities can be carried out concurrently in a pit. A bench, which may be for example 40-200 m long by 20-100 m deep by 10-15 m high and containing many thousands of tonnes of ore and/or other material, is first drilled to form a pattern of "blast" holes. The material removed during the course of drilling the blast holes is analysed, for example by chemical analysis, to determine whether, on average, the ore is (a) high grade, (b) low grade or (c) waste material. The cut-off between high and low grades is dependent on a range of factors and may vary from mine to mine and in different sections of mines. The bench of ore is blasted using explosives, typically ANFO (ammonium nitrate/fuel oil) based, that are dispensed in specially designed bulk dispensing trucks which can regulate the explosive density prior to loading down the hole. The blasted material is picked up by earth moving vehicles in the form of excavators such as electric rope shovels, diesel hydraulic excavators, or front end loaders and placed into haulage vehicles such as trucks and transported to downstream processing plants to produce marketable products to customer specifications. Downstream processing ranges from simple crushing and screening to a standard size to processes that upgrade the ore. These processes may be wet or dry processes.

The present invention is based on a realisation that limiting the extent of interaction of unmanned and manned resources as described above is advantageous because it makes it possible to optimise operation of unmanned resources. One option for limiting interaction identified by the applicant (and the subject of the present invention) is to separate access for manned resources and unmanned resources to the mine area at selected locations. Another option for limiting interaction identified by the applicant (and the subject of the present invention) is to provide manned resources and unmanned resources operating in selected, separate unmanned and manned zones. Both options make it possible to carrying out mining operations in a very flexible way in order to maximise efficiency of mining in a mine area. In particular, both options make it possible to change the sections of the mine area in which unmanned and manned resources operate quickly to take into account changing requirements for the mine area.

According to the present invention there is provided a method of open cut mining an ore that comprises carrying out mining operations in an area of an open cut mine with manned resources and unmanned resources and providing separate access for manned resources and unmanned resources to the mine area at selected locations.

According to the present invention there is also provided a method of open cut mining an ore that comprises carrying out mining operations in an area of an open cut mine with manned resources and unmanned resources operating in selected, separate unmanned and manned zones, respectively, as described herein within the mine area.

The term "mining operations" is understood herein to comprise the operations that are required in a given mine to remove ore from a mine pit.

In many situations, the term "mining operations" includes the above-described drilling and blasting and subsequent ore excavation and removal via haulage vehicles.

In other situations, the term "mining operations" includes different unit operations and combinations of unit operations.

The term "separate unmanned and manned zones" is understood herein to mean one or more than one zone in which unmanned resources (such as haulage vehicles) operate and one or more than one zone in which manned resources operate, with the zones being separate zones in the mine area.

The term "separate unmanned and manned zones" is understood herein to include zones that at least partly share a common boundary.

The term "separate unmanned and manned zones" is also understood herein to include zones that are separated by intermediate sections of the mine area.

By way of particular example, the method may include using unmanned haulage trucks in the mining operations.

The term "unmanned haulage trucks" is understood herein to mean vehicles for transporting ore from the mine area that are remotely controlled or operate autonomously for at least a part of the operating period of the trucks and, typically, are remotely controlled or operate autonomously whilst carrying out pre-determined operations within a mine pit.

The pre-determined operations for haulage trucks may include driving into a mine pit to a location proximate an earth moving vehicle (which may be manned or unmanned) and being loaded with ore via the earth moving vehicle and driving out of the mine pit when the truck is fully loaded.

The method may include using unmanned haulage trucks and other unmanned vehicles in the mining operations. As is the case with the unmanned haulage trucks, these vehicles are understood herein to mean vehicles that are remotely controlled or operate autonomously for at least a part of the operating period of the vehicles and, typically, are remotely controlled or autonomously operated whilst carrying out pre-determined operations within a mine pit. For example, the unmanned vehicles may include any one or more of earth moving vehicles (such as front end loaders), and drill rigs for drilling blast holes. The pre-determined operations for earth moving vehicles may include moving autonomously within a pit and picking up ore and loading the ore into a haulage truck.

The method may include providing identifiable access roads for manned and unmanned resources within the mine area.

The method may include changing the manned and unmanned zones as mining operations progress in the mine area having regard to the requirements of the mining operations. In particular, the method may include changing the size of manned and unmanned zones in response to a change in the location of loading ore for haulage out of the mine area. By way of example, after a new section of the mine area is drilled and blasted or otherwise made ready for excavation, the size of an unmanned zone that is proximate the section can be increased to allow unmanned haulage trucks to move into the section and be loaded with ore that is picked up by excavators. In situations where the excavators are manned vehicles, the excavators will be regarded as respective manned zones that are adjacent the unmanned zone for the unmanned haulage trucks. In situations where the excavators are unmanned vehicles, the excavators will be regarded as respective unmanned zones that are adjacent the unmanned zone for the unmanned haulage trucks. By way of further example, in situations where maintenance of equipment, manned or unmanned, has to be carried out in the mine area and it is necessary for maintenance engineers to gain access to and then to work on the equipment, the unmanned and manned zones may be moved to allow this to occur. By way of particular example, if a manned excavator requires maintenance, the mine operator may re-define an unmanned zone or zones for unmanned haulage trucks and/or other unmanned resources to allow access of maintenance engineers into the mine area to work on the excavator. In this situation, the re-definition of the unmanned zone or zones makes it possible to continue to allow unmanned resources to operate with maximum productivity and to allow safe access of maintenance engineers to the mine area. By way of further example, at shift change-over, the mine operator may re-define an unmanned zone or zones for unmanned haulage trucks and/or other unmanned resources to allow equipment operators to move into and from the mine safely while maintaining optimum productivity of unmanned resources.

It is evident from the above that providing unmanned and manned zones provides an opportunity for considerable flexibility in terms of the operations that can be carried out in different sections of the mine area and the capacity of the method to adapt quickly and accommodate changing circumstances in the mine area.

Typically, the proportion of the unmanned zone or zones increases as the mining operations progress within the area until, ultimately, the whole of the area has been mined and is at least substantially an unmanned zone.

The method may include carrying out different mining operations in different sections of the unmanned zone or zones as mining operations progress in the mine area.

The method may include carrying out different mining operations in different sections of the manned zone or zones as mining operations progress in the mine area.

By way of example, each unmanned zone may comprise a mining section and a roadway that connects the mining section to an access location to allow movement of unmanned resources to and from the mining section.

The method may include precluding access of unmanned resources into the manned zone or zones. The access may be precluded by physical and non-physical barriers.

The method may include precluding access of manned resources into the unmanned zone or zones. The access may be precluded by physical and non-physical barriers.

The operations in the manned zone may include any one or more of grading the zone, taking samples of ore in the zone for analysis, and drilling blast holes, charging explosives into the blast holes, and blasting at least a part of the zone to release ore for removal from the mine.

The method may include providing at least 3 access locations.

The method may include selecting the locations of the resource access locations to maximise productivity of mining operations in the mine area.

The mine access locations may be in different parts of the perimeter of the mine area.

The mine access locations may be in one part of the perimeter of the mine area and separated by a barrier that prevents cross-over of unmanned and manned resources.

The barrier may be a physical barrier. The present invention is not limited to the use of physical barriers and extends to the use of non-physical barriers.

The method may include providing timed access for unmanned and manned resources to travel through each resource access location to minimise the risk of interaction.

The access locations may include vehicle drive-off sections to allow vehicles (manned or unmanned) to park temporarily while other vehicles move through the access locations.

The method may include establishing new resource access locations to the mine area as mining progresses within the area so as to maintain separation of unmanned and manned mining operations within the area. This step may include increasing the overall number of the access locations to the mine area.

The method may include changing the resource access locations to the mine area as mining operations progress in the mine area to allow access of unmanned resources and manned resources to new unmanned zones and manned zones, respectively, to allow efficient mining operations to continue in the mine area.

In situations where there are at least 2 resource access locations for manned resources, the method may include changing the access through such locations in response to changes in the location of unmanned and manned zones in the mine area.

The method may include changing the size of an unmanned zone for the haulage of ore out of the mine area in response to changes in the location of loading of ore for haulage out of the mine area.

The method may include changing the size of an unmanned zone for the haulage of ore out of the mine area to retain the same resource access location or locations to the unmanned zone.

The method may include changing the amount of use of each resource access location to preferentially minimise the amount of disruption to the unmanned resources within the unmanned zone or zones for the haulage of ore during any adjustment in the zones in response to a change in location of loading of ore for haulage out of the mine area.

The method may include the following steps:

(a) blasting a section of a bench in the mine area;

(b) bringing in excavators (manned or unmanned) and unmanned haulage trucks and remove blasted material from the mine area; and (c) preparing a new section of the bench for blasting at a later time.

Typically, the unmanned haulage vehicles are trucks that operate under remote-control or autonomously when operating in the mine area.

The method may include carrying out mining operations on multiple faces of one or more benches in the mine area. In such a situation, there may be multiple, separate unmanned zones with separate groups of unmanned resources operating in these zones. Alternatively, there may be one group of unmanned resources, such as unmanned haulage vehicles, that are used successively in different unmanned zones. Furthermore, in such situations, there may be multiple unmanned resources travelling through access locations to and from the unmanned zones.

The present invention is described further with reference to the accompanying drawings, of which:

FIGS. 1 to 9 are a series of perspective views that show the steps involved in mining an area of an underground mine in one embodiment of a method of mining iron ore in accordance with the present invention.

It is noted that the area to be mined may comprise the whole of a mine or a part of the mine. In the latter case, it can be appreciated that the mine may comprise a number of different areas that are mined using the same or different methods, as a consequence of the geology and other relevant mining factors.

Each of the perspective views in the Figures is described in the context of mining iron ore by blasting blocks, for example a 60,000 tonne blocks, of iron ore from a bench, picking up the ore from a pit floor by manned earth moving equipment in the form of excavators such as electric rope shovels, diesel hydraulic excavators, or front end loaders, placing the ore into unmanned haulage equipment in the form of unmanned haulage trucks, and transporting the ore to downstream processing plants (not shown) to produce marketable products to customer specifications.

In addition, each of the perspective views in the Figures is described in the context of using manned resources to carry out a range of mining operations in the mine area. The manned mining operations include grading a section of a bench of the mine area to be subsequently drilled and blasted, drilling blast holes, obtaining samples of ore from the blast holes for analysis, and charging the blast holes with explosives.

In addition, each of the perspective views in the Figures is described in the context of a method of open cut mining that comprises carrying out mining operations in the mine with manned resources and unmanned resources by selectively dividing an area of the mine into (a) one or more than one zone for operation of unmanned resources to the exclusion of manned resources and operating the unmanned resources in that unmanned zone or zones and (b) one or more than one zone for operation of manned resources to the exclusion of unmanned resources and operating the manned resources in that manned zone or zones.

In addition, each of the perspective views in the Figures is described in the context of providing separate access locations for unmanned resources and manned resources. The locations of the access locations are selected to maximise productivity of mining operations in the mine.

With reference to FIG. 1, the area enclosed by the perimeter X is the area to be mined in an open cut mining operation. As described above, the mine area is an area that is to be mined using a combination of manned and unmanned resources.

In this embodiment, the manned resources comprise equipment in the form of earth moving vehicles (in the form of front end loaders), dozers, graders, drill rigs, water trucks, hole charging, survey trucks, explosives trucks and the unmanned resources comprise equipment in the form of unmanned haulage trucks. The following description refers to manned resources as "manned vehicles" and unmanned resources as "unmanned vehicles" and, particularly as "unmanned haulage vehicles". It is noted that focusing the description on "manned vehicles" and "unmanned haulage trucks" is for the purpose of simplifying the description. Equally, the present invention includes embodiments in which the manned equipment includes other types of excavators such as rope shovels and hydraulic excavators and is not limited to "vehicles" and the unmanned equipment includes any one or more of the equipment mentioned above as being manned equipment, such as drill rigs.

In this embodiment, having regard to a series of factors, the mine operator decided that the area would be mined from the south west end of the area in an easterly direction, noting that north is identified by the arrow marked "North" in the Figures. As a consequence of this decision, in order to facilitate safe access of manned vehicles and unmanned vehicles to the mine area, the operator selected three access locations 3, 5, 6 in the perimeter X. The access location 3, which is in the south west end of the mine area, was selected to provide access for unmanned haulage vehicles only. The access locations 5, 6, which are approximately one third of the way along the respective south and north borders of the area, were selected to provide access to manned vehicles only. The selection was driven by the need to minimise the risk of collision of unmanned haulage vehicles and manned vehicles and to maximise mine productivity and to minimise operating costs.

In addition to the above, having regard to a series of mining-related factors, the mine operator selected a zone 7, described as the "AHS Fleet Island" and the "Unmanned Area" in FIG. 1, that is immediately adjacent the access location 3 to be a zone for operation of the unmanned haulage vehicles. The remainder of the area was selected to be a zone 9 for operation of manned vehicles to the exclusion of unmanned haulage vehicles. This zone 9 is described as the "Manned Area" in FIG. 1. The common boundary of these zones 7, 9 is identified by the numerals 11, 13 in FIG. 1. Access into manned or unmanned zones may be precluded by a physical barrier 10.

The unmanned zone 7 is a region in which manually-operated front end loaders pick up and load blasted ore onto autonomously-operated haulage trucks that transport the ore from the mine via the access location 3. The unmanned zone 7 in FIG. 1 is typically formed as a drop cut. It is noted that, strictly speaking, the unmanned zone 7 is effectively two types of zones, with the first and more substantial type of zone being a zone in which the autonomously-operated haulage trucks operate and the other type of zone being a manned zone in which the manually-operated front end loaders operate. The two types of zones are described as an unmanned zone 7 in order to simplify the description.

As work continues in the unmanned zone 7, one or more than one new section of the manned zone 9 is prepared for drilling and blasting. This work involves movement of equipment described above onto and from the unmanned zone 9 via the access locations 5, 6.

With further reference to FIG. 1, the next section of the manned zone 9 to be blasted is a section that is immediately east of the unmanned zone 7 shown in the Figure. This section is identified by the cross-hatching in FIG. 1.

Figure 2:
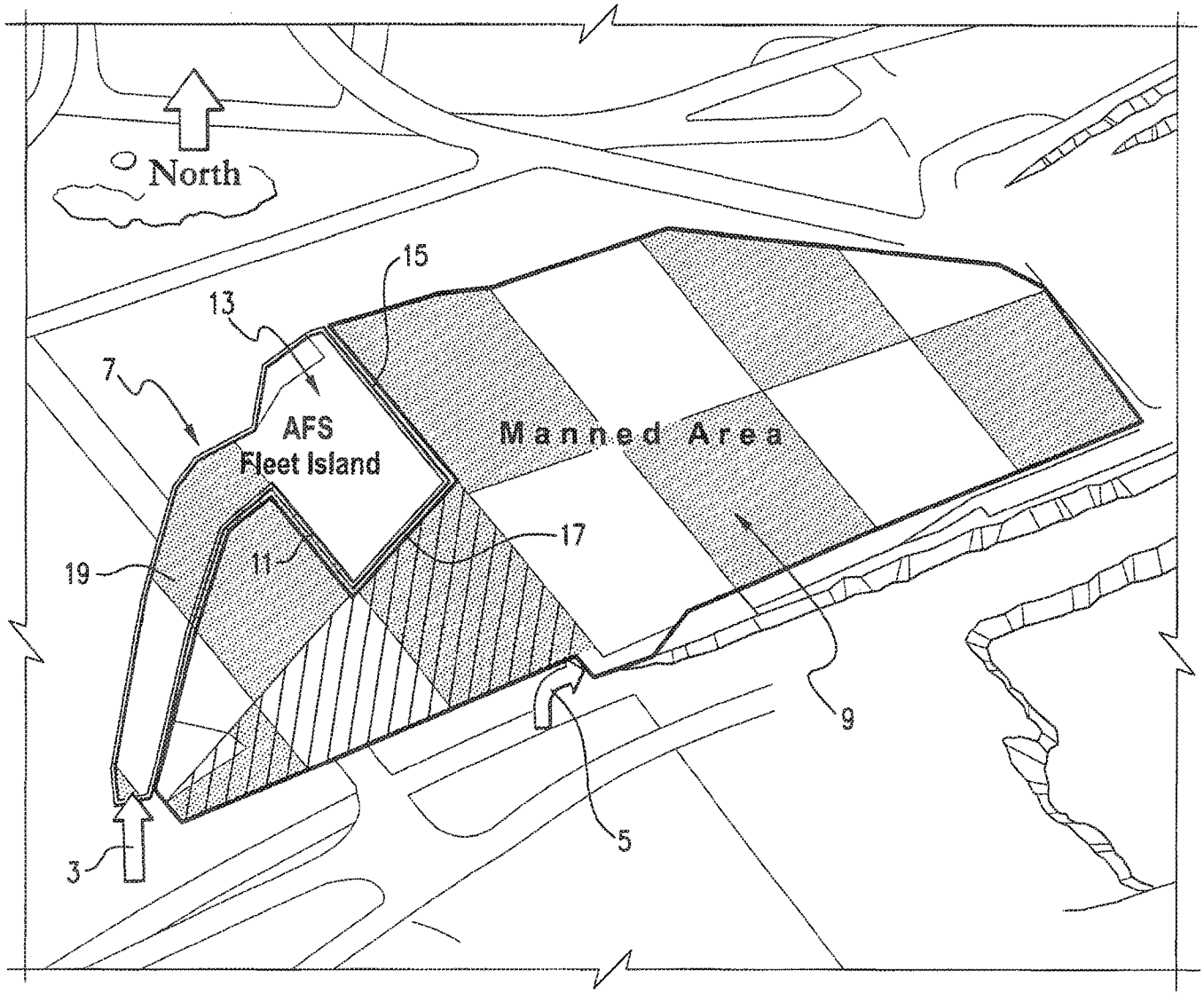

With reference to FIG. 2, after blasting this new section becomes part of the unmanned zone 7 and is described as an "AFS Fleet Island" and identified generally by the numeral 13 in the Figure. This section has boundaries with the manned zone 9 that are identified by the numerals 15, 17. Front end loaders operate in the new "AFS Fleet Island" 13 and pick-up and load blasted ore onto autonomously-operated haulage trucks that transport the ore from the mined area via a roadway 19 and the access location 3.

With further reference to FIG. 2, the next stage in the extension of mining operations in the mine area involves blasting the section of the manned zone 9 that is immediately south of the AFS Fleet Island 13 shown in the Figure. This section is identified by cross-hatching in FIG. 2.

Figure 3:
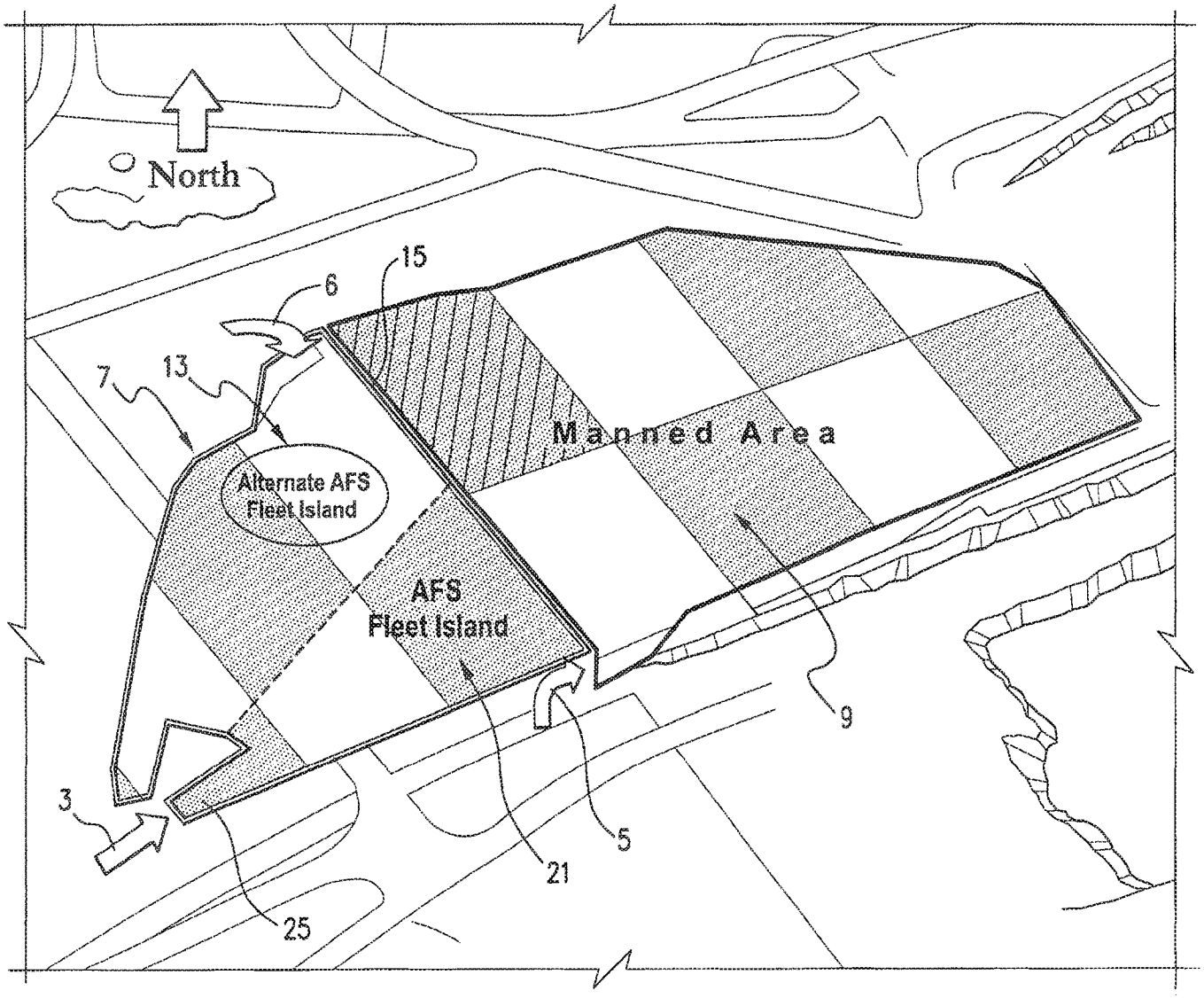

As a consequence, after blasting a new AFS Fleet Island 21 is formed, as shown in FIG. 3. In addition, a new access location 25, adjacent the access location 3, is constructed to allow access to the AFS Fleet Island 21. Front end loaders operate in the AFS Fleet Island 21 and pick-up and load blasted ore onto autonomously-operated haulage trucks that transport the ore from the mined area via the access location 25.

The AFS Fleet Island 13 remains part of the overall unmanned zone 7 of the mined area and becomes what is described in FIG. 3 as an "Alternate AFS Fleet Island" 13. Autonomous mining operations, if required, continue in this zone as required, with access into and out of the zone via the access location 3. Typically, mining will be complete in this zone by this stage. Moreover, if required for subsequent mining operations, manned vehicle access to this zone is possible via the access location 3.

The new AFS Fleet Island 21 and the Alternate AFS Fleet Island 13 have boundaries with the manned zone 9 that are identified by the numeral 15 in FIG. 3.

With further reference to FIG. 3, the next stage in the extension of mining operations in the mine area involves blasting the section of the manned zone 9 that is immediately east of the Alternate AFS Fleet Island 13 shown in the Figure. This section is identified by cross-hatching in FIG. 3.

Figure 4:
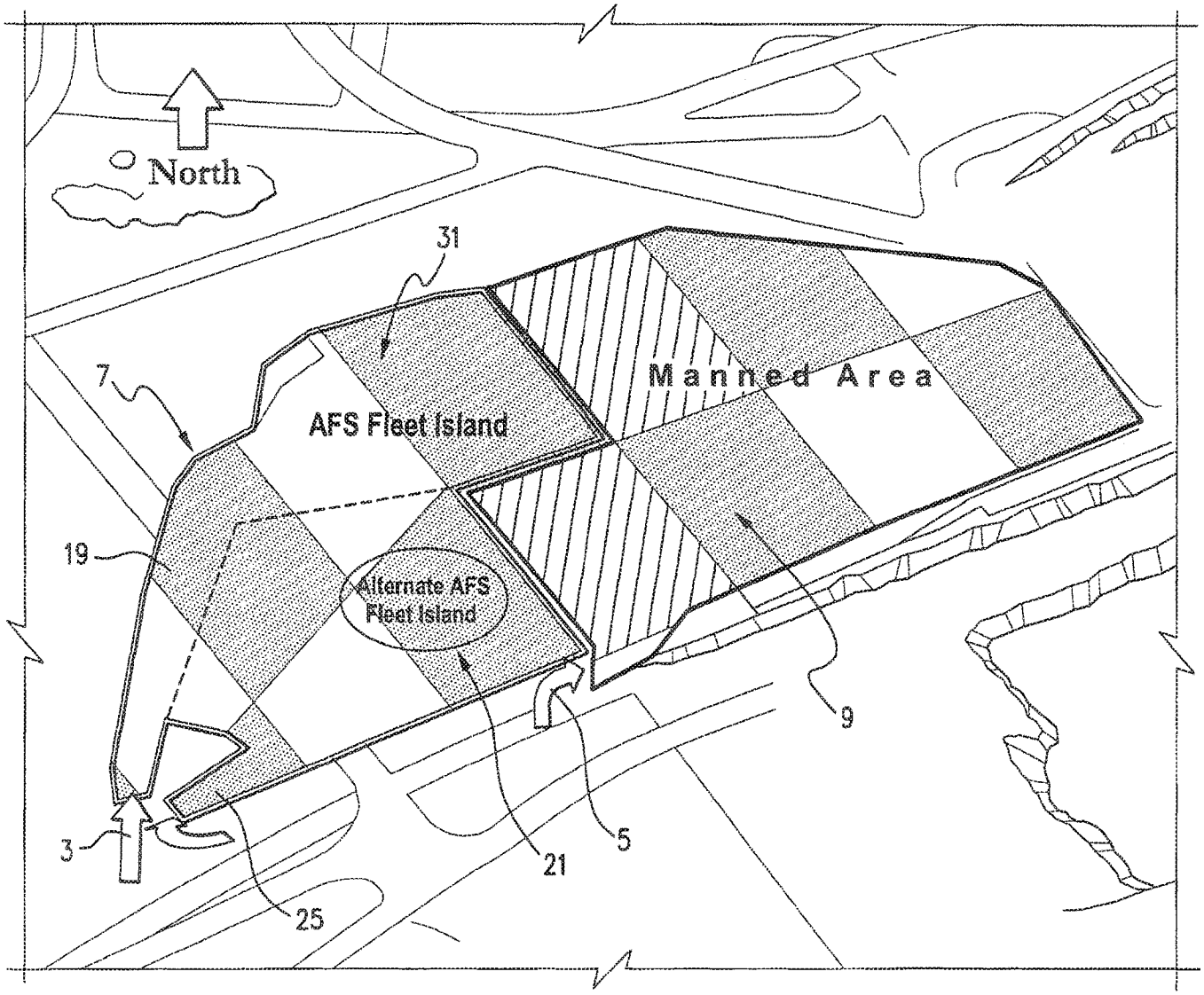

As a consequence, with reference to FIG. 4, after blasting, a new AFS Fleet Island 31 is formed. In effect, this is an extension of the existing island 13. Access to the new AFS Fleet Island 31 is via the access location 3 and the roadway 19. Front end loaders operate in the AFS Fleet Island 31 and pick-up and load blasted ore onto autonomously-operated haulage trucks that transport the ore from the mined area via the access location 3.

The previously-described AFS Fleet Island 21 remains part of the overall unmanned zone 7 of the mined area and becomes what is described in FIG. 4 as an "Alternate AFS Fleet Island" 21. Autonomous mining operations continue in this zone as required, with access into and out of the zone via the access location 25. Typically, mining will be complete in this zone by this stage. Moreover, if required for subsequent mining operations, manned vehicle access to this zone is possible via the access location 25.

With further reference to FIG. 4, the next stage in the extension of mining operations in the mine area involves blasting the section of the manned zone 9 that is immediately east of each of the Alternate AFS Fleet Island 21 and the AFS Fleet Island 31 shown in the Figure. This section is identified by cross-hatching in FIG. 4.

Figure 5:
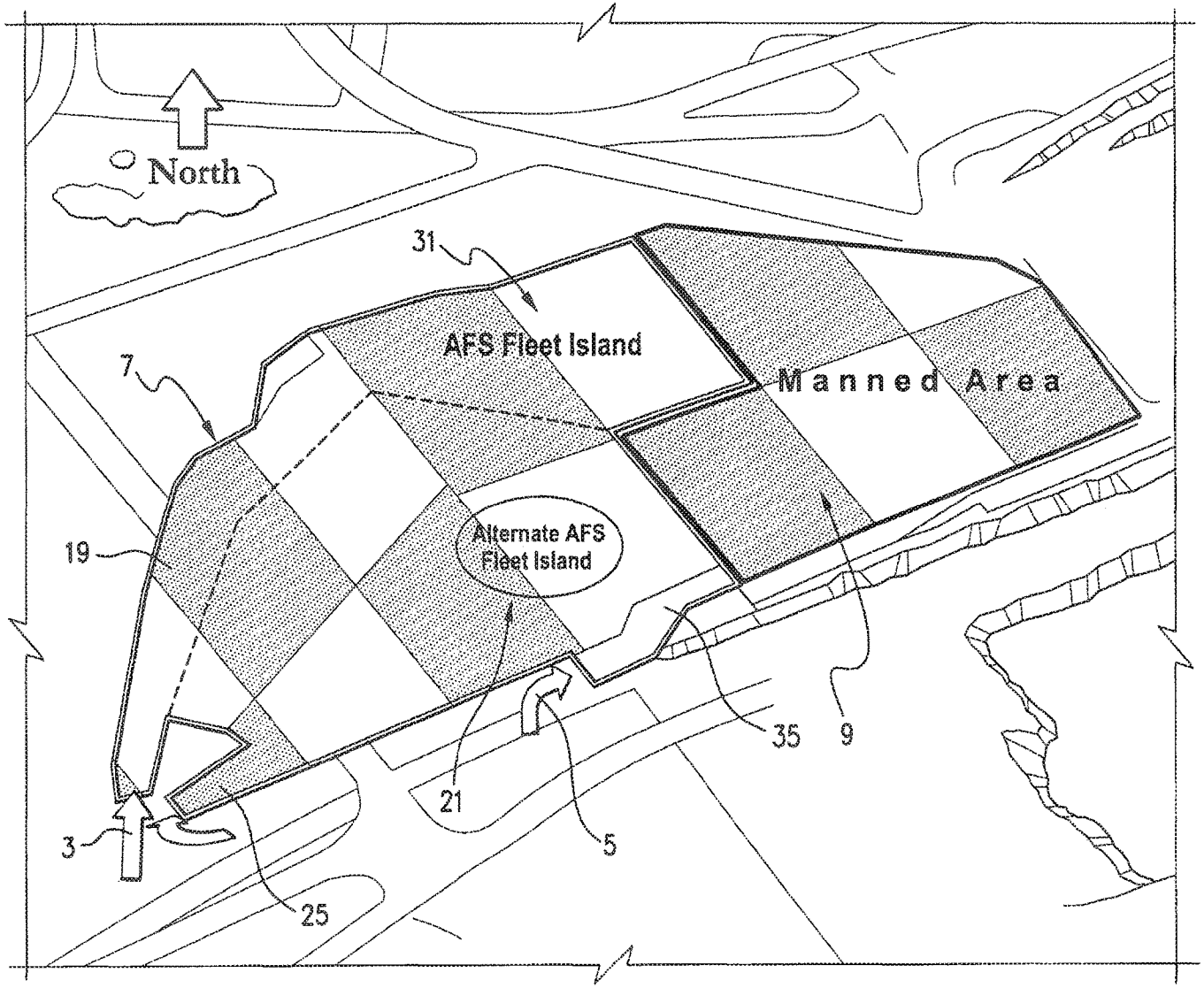

As a consequence, with reference to FIG. 5, a new AFS Fleet Island 31 is formed. In effect, this is an extension of the existing island. Access to the new AFS Fleet Island 31 continues to be via the access location 3 and the roadway 19 within the unmanned zone 7. Front end loaders operate in the AFS Fleet Island 31 and pick-up and load blasted ore onto autonomously-operated haulage trucks that transport the ore from the mined area via the access location 3.

In addition to extending the AFS Fleet Island 31 shown in FIG. 4, this further mining operation also extends the Alternate AFS Fleet Island 21 shown in that Figure. Autonomous mining operations continue in this zone as required, with access into and out of the zone continuing to be via the access location 25. However, typically, mining will be complete in this zone by this stage. Moreover, if required for subsequent mining operations, manned vehicle access to this zone is possible via the access location 25.

The expansion of the unmanned zone 7 makes it necessary to extend the access road at the access location 5. In particular, it is necessary to form a ramp 35 that allows vehicles to drive onto the manned zone 9.

Figure 6:
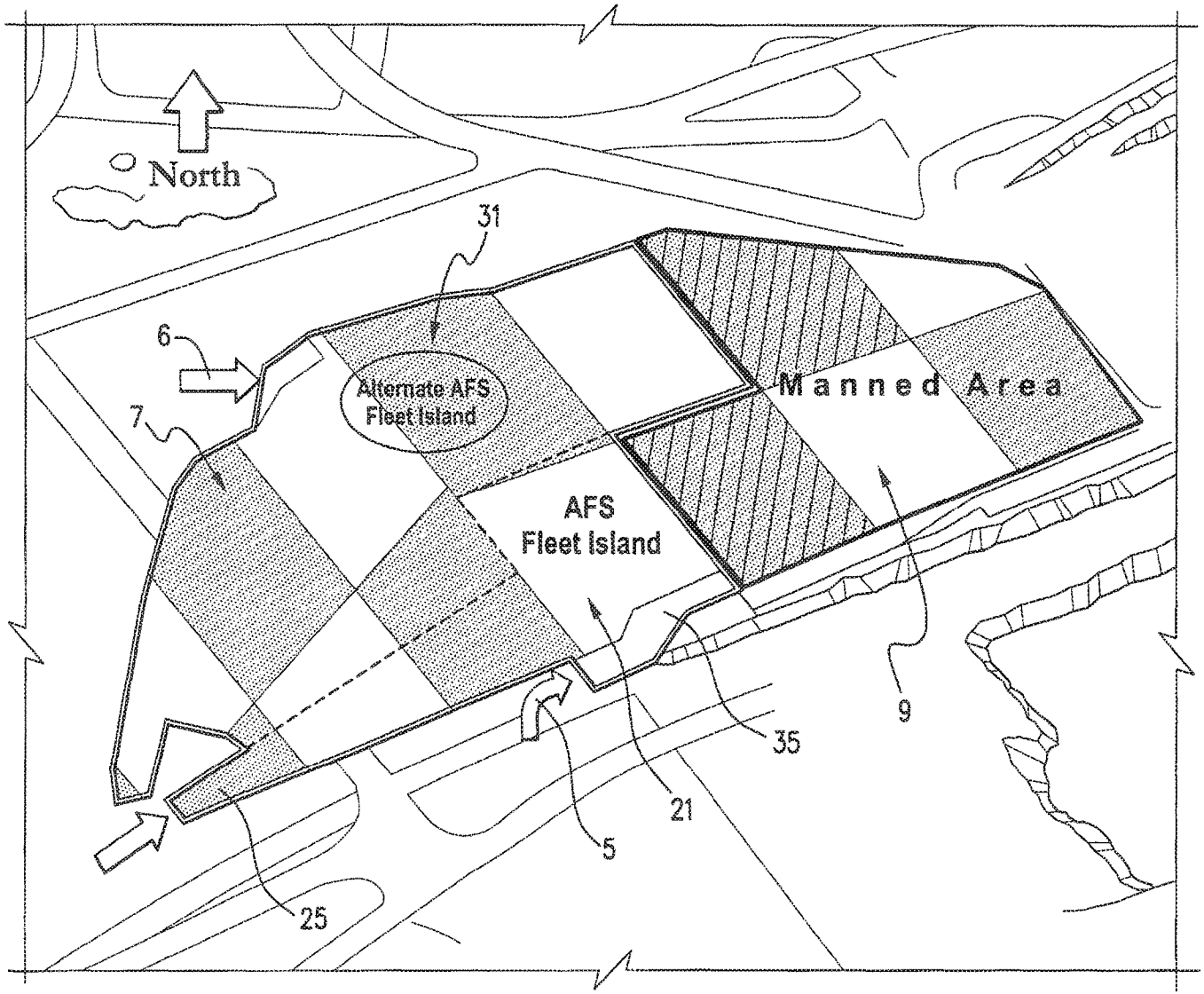

After autonomous mining in the new AFS Fleet Island 31 is completed, the autonomous mining fleet operating in this area is swung across to mine the new Alternate AFS Fleet Island 21. This switch in operations is shown in FIG. 6. Mined material is removed from this zone 21—which in effect becomes a new AFS Fleet Island—via the access location 25.

With further reference to FIG. 6, the next stage in the extension of mining operations in the mine area involves blasting the section of the manned zone 9 that is immediately east of each of the Alternate AFS Fleet Island 31 and the AFS Fleet Island 21 shown in the Figure. This section is identified by cross-hatching in FIG. 6.

Figure 7:
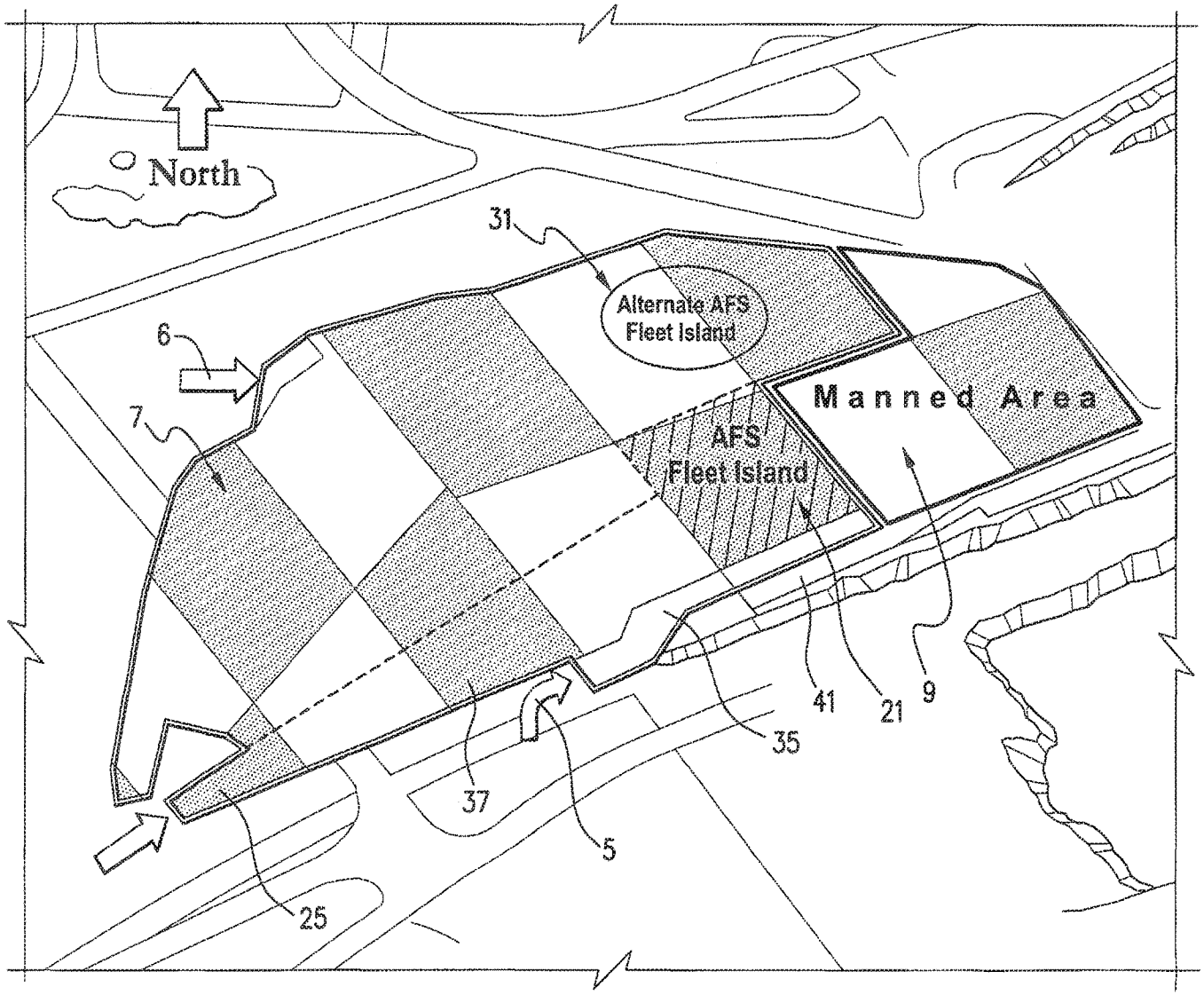

As a consequence, with reference to FIG. 7, a new AFS Fleet Island 21 is formed. In effect, this is an extension of the existing island. Access to the new AFS Fleet Island 21 continues to be via the access location 25 and a roadway 37 within the unmanned zone 7. Front end loaders operate in the AFS Fleet Island 21 and pick-up and load blasted ore onto autonomously-operated haulage trucks that transport the ore from the mined area via the access location 25.

In addition to extending the AFS Fleet Island 21 shown in FIG. 6, this mining operation also extends the Alternate AFS Fleet Island 31 shown in that Figure. Autonomous mining operations continue in this zone as required, with access into and out of the zone via the access location 6. Typically, mining will be complete in this zone by this stage. Moreover, if required for subsequent mining operations, manned vehicle access to this zone is possible via the access location 6.

The expansion of the unmanned zone 7 makes it necessary to further extend the access road at the access location 5. In particular, it is necessary to construct a roadway 41 as an extension of the ramp 35.

Figure 8:
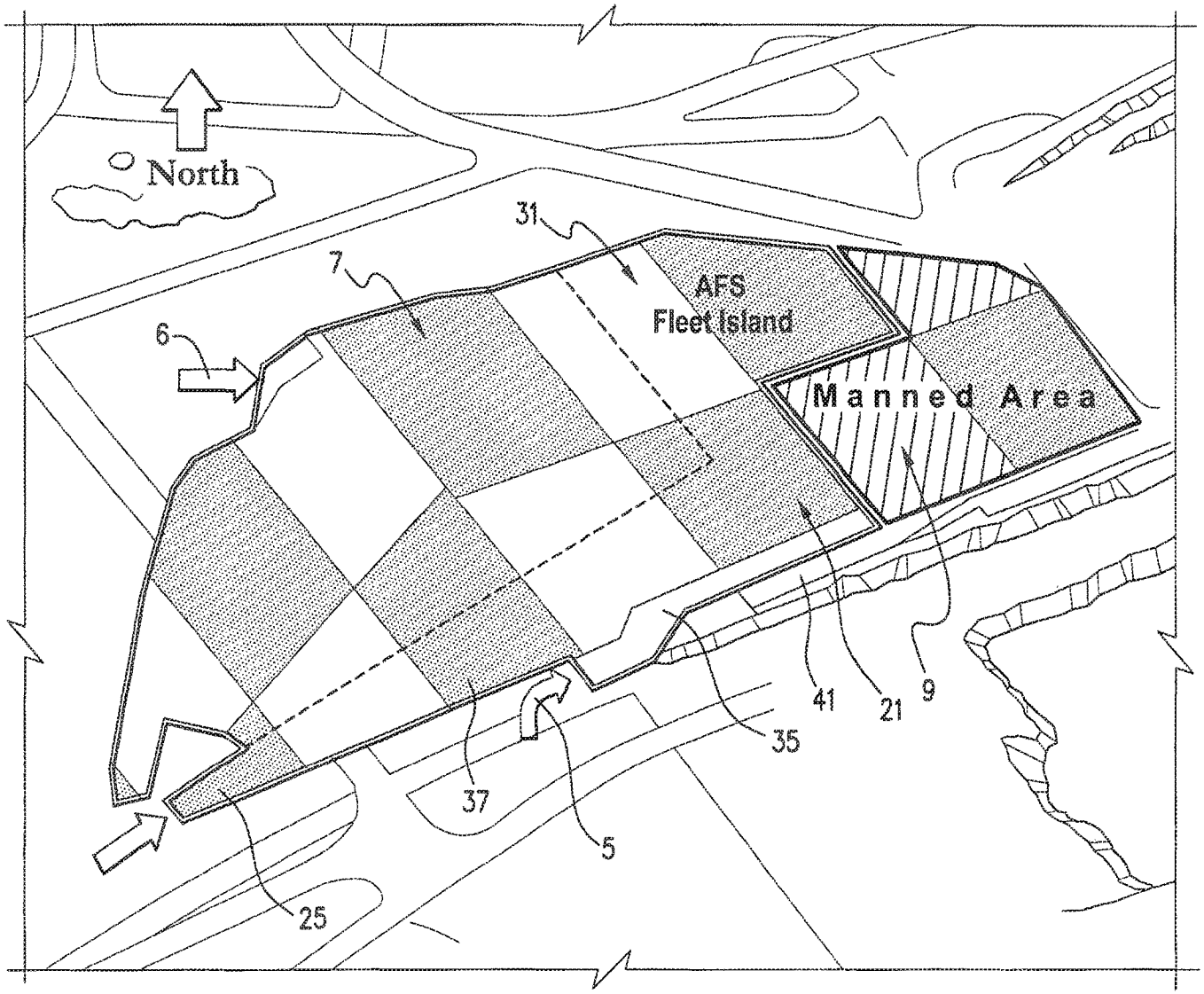

After autonomous mining in the new AFS Fleet Island 21 is completed, the autonomous mining fleet can be swung across to mine the Alternate AFS Fleet Island 31. This switch in operations is shown in FIG. 8. Mined material is removed from this zone 31—which in effect becomes a new AFS Fleet Island—via the access location 25.

With further reference to FIG. 8, the next and final stage in the extension of mining operations in the mine area involves blasting the section of the manned zone 9 that is immediately east of the Alternate AFS Fleet Island 31 and the AFS Fleet Island 21 shown in the Figure. This section is identified by cross-hatching in FIG. 8.

Figure 9:
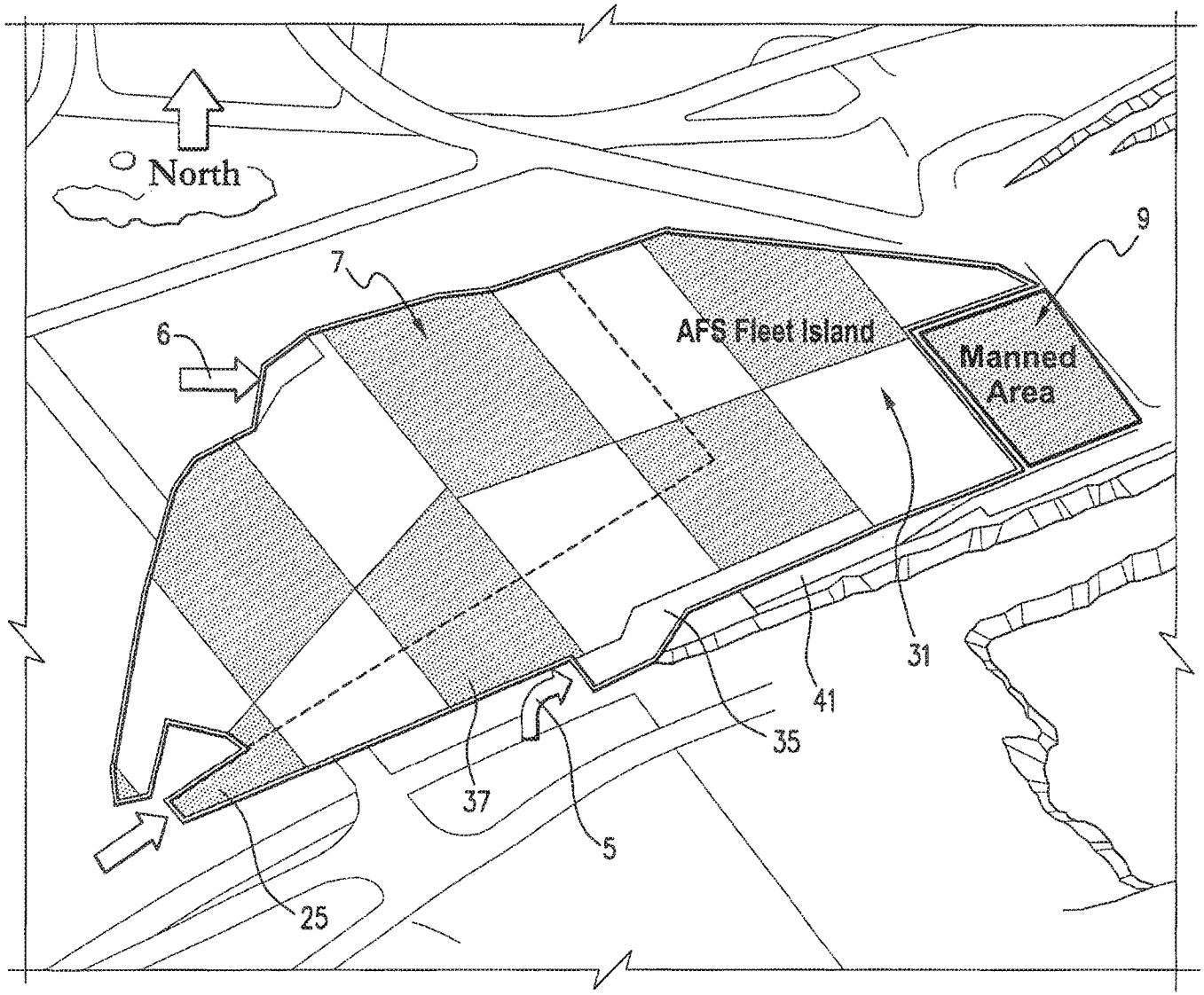

As a consequence, with reference to FIG. 9, a new AFS Fleet Island 31 is formed. In effect, this is an extension of the existing Alternate AFS Fleet Island 21 and the AFS Fleet Island 31. Access to the new AFS Fleet Island 31 is via the access location 25 and the roadway 37 within the unmanned zone 7. Front end loaders operate in the AFS Fleet Island 31 and pick-up and load blasted ore onto autonomously-operated haulage trucks that transport the ore from the mined area via the access location 25.

The expansion of the unmanned zone 7 makes it necessary to further extend the access road at the access location 5. In particular, it is necessary to extend the roadway 41 on the manned zone 9.

After autonomous mining in the new AFS Fleet Island 31 is completed, the part remaining of the manned zone 9 can be mined.

The above sequence of stages that is illustrated in FIGS. 1 to 9 mines ore to one level in the mine area. The series of stages can be repeated to mine successive levels of ore from the mine area.

Many modifications may be made to the embodiment of the present invention described above in relation to FIGS. 1 to 9 without departing from the spirit and scope of the invention.

By way of example, whilst the above-described embodiment includes the use of haulage vehicles as unmanned vehicles, the present invention is not so limited and other mining equipment that is described above as being operated as manned vehicles may be remotely-controlled or operated autonomously. For example, the present invention extends to the use of unmanned resources such as earth moving vehicles as remote-controlled or autonomously operated excavators.

In addition, whilst the above-described embodiment includes swinging the fleet of unmanned haulage vehicles between AFS Fleet Islands and Alternate AFS Fleet Islands shown in the Figure, the present invention is not so limited and extends to arrangements in which there are multiple fleets of unmanned haulage vehicles (or other unmanned resources) operating in multiple AFS Fleet Islands and Alternate AFS Fleet Islands.

In addition, whilst the above-described embodiment includes the use of access locations for manned vehicles and separate access locations for unmanned haulage vehicles, the present invention is not so limited and extends to arrangements in which the same access locations are used for both types of vehicles and other forms of unmanned and manned resources. For example, an access location may be set up so that there are separate pathways for the different vehicles through the location. By way of further example, there may be timed access for vehicles through the location, in the sense that the unmanned haulage vehicles are able to move through an access location during one time period and manned vehicles are able to move through the access location at another time period.

What is claimed is:

1. An open cut mine, the open cut mine including an area bounded by a perimeter, the area including (a) a manned zone within the perimeter comprising more than one manned resources wherein the manned resources are selected from the group consisting of manned front end loaders, dozers, graders, drill rigs, water trucks, survey trucks, and explosives trucks, and the manned resources operate to the exclusion of unmanned resources, (b) an unmanned zone within the perimeter comprising more than one of the unmanned resources wherein the unmanned resources operate to the exclusion of manned resources, (c) a first manned resource access location in the perimeter including a roadway through which the manned resources move into and from the manned zone, and (d) a second unmanned resource access location in the perimeter separate from the first manned resource access location and including a roadway through which unmanned resources move into and from the unmanned zone.

2. The open cut mine defined in claim 1 wherein different sections of the manned zone contain different mining operations.

3. The open cut mine defined in claim 2 wherein the different mining operations in the manned zone comprise any one or more of grading the zone, taking samples of ore in the zone for analysis, and drilling blast holes, charging explosives into the blast holes, and blasting at least a part of the zone to release ore for removal from the mine.

4. The open cut mine defined in claim 1 wherein different sections of the unmanned zone contain different mining operations.

5. The open cut mine of claim 1 wherein unmanned resources are precluded access into the manned zone or manned resources are precluded access into the unmanned zone.

6. The open cut mine of claim 1 wherein the manned zone and unmanned zone are separated by physical barriers.

7. The open cut mine of claim 1 wherein the first manned resource access location and the second manned resource access location are separated by physical barriers.

* * * * *